US006426328B2

(12) United States Patent
Murphy et al.

(10) Patent No.: US 6,426,328 B2
(45) **Date of Patent: *Jul. 30, 2002**

(54) WRINKLE REDUCTION LAUNDRY PRODUCT COMPOSITIONS

(75) Inventors: Dennis Stephen Murphy, Leonia; Daniel Fox, Tenafly, both of NJ (US)

(73) Assignee: Unilever Home & Personal Care, USA division of Conopco Inc., Greenwich, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/393,831

(22) Filed: Sep. 10, 1999

Related U.S. Application Data

(63) Continuation-in-part of application No. 09/293,754, filed on Apr. 16, 1999.

(60) Provisional application No. 60/105,865, filed on Oct. 27, 1998.

(51) Int. Cl.[7] ..... C11D 17/06; C11D 7/44; B08B 7/00

(52) U.S. Cl. ..... 510/445; 510/446; 510/463; 510/513; 510/505; 134/42

(58) Field of Search ..... 510/400, 445, 510/446, 447, 466, 463, 513, 505; 134/42

(56) References Cited

U.S. PATENT DOCUMENTS

| | | | | |
|---|---|---|---|---|
| 3,619,115 | A | 11/1971 | Diehl et al. | |
| 3,864,475 | A | 2/1975 | Willard, Sr. | |
| 3,874,927 | A | 4/1975 | Willard, Sr. | |
| 3,915,738 | A | 10/1975 | Willard, Sr. | |
| 3,918,983 | A | 11/1975 | Papalos | |
| 3,931,031 | A | 1/1976 | Willard, Sr. | |
| 3,992,332 | A | 11/1976 | Zenon | |
| 4,237,155 | A | 12/1980 | Kardouche | |
| 4,238,531 | A | 12/1980 | Rudy et al. | |
| 4,261,868 | A | 4/1981 | Hora et al. | |
| 4,264,465 | A * | 4/1981 | Abel | 252/99 |
| 4,322,308 | A | 3/1982 | Hooper et al. | |
| 4,327,133 | A | 4/1982 | Rudy et al. | |
| 4,400,288 | A | 8/1983 | Dhanani et al. | |
| 4,421,792 | A | 12/1983 | Rudy et al. | |
| 4,639,321 | A | 1/1987 | Barrat et al. | |
| 4,652,392 | A | 3/1987 | Baginski et al. | |
| 4,698,178 | A | 10/1987 | Huttinger et al. | |
| 4,784,799 | A | 11/1988 | Petroff | |
| 4,846,982 | A | 7/1989 | Madore et al. | |
| 4,911,852 | A | 3/1990 | Coffindaffer et al. | |
| 4,911,853 | A | 3/1990 | Coffindaffer et al. | |
| 4,959,179 | A | 9/1990 | Aronson et al. | |
| 4,978,471 | A | 12/1990 | Starch | |
| 5,064,544 | A | 11/1991 | Lin et al. | |
| 5,089,163 | A | 2/1992 | Aronson et al. | |
| 5,094,761 | A | 3/1992 | Trinh et al. | |
| RE34,062 | E | 9/1992 | Wells | |
| 5,147,576 | A | 9/1992 | Montague et al. | |
| 5,171,476 | A | 12/1992 | Bloodworth et al. | |
| 5,205,957 | A | 4/1993 | Van de Pas | |
| 5,234,610 | A | 8/1993 | Gardlik et al. | |
| 5,271,868 | A | 12/1993 | Azechi et al. | |
| 5,288,417 | A | 2/1994 | Bauer et al. | |
| 5,348,667 | A | 9/1994 | Bacon et al. | |
| 5,360,571 | A | 11/1994 | Kilgour et al. | |
| 5,376,287 | A | 12/1994 | Borcher, Sr. et al. | |
| 5,403,499 | A | 4/1995 | Kiefer et al. | |
| 5,411,671 | A | 5/1995 | Bauer et al. | |
| 5,441,667 | A | 8/1995 | Dauderman et al. | |
| 5,449,609 | A | 9/1995 | Paszek | |
| 5,460,736 | A | 10/1995 | Trinh et al. | |
| 5,545,350 | A | 8/1996 | Baker et al. | |
| 5,560,872 | A * | 10/1996 | Rahman et al. | 510/392 |
| 5,562,849 | A | 10/1996 | Wahl et al. | |
| 5,629,376 | A * | 5/1997 | Sargent et al. | 524/745 |
| 5,645,751 | A | 7/1997 | Haley | |
| 5,648,327 | A | 7/1997 | Smerznsak et al. | |
| 5,656,584 | A * | 8/1997 | Angell et al. | 510/441 |

(List continued on next page.)

FOREIGN PATENT DOCUMENTS

| | | |
|---|---|---|
| EP | 0 242 919 | 10/1987 |
| EP | 0 255 711 A2 | 2/1988 |
| EP | 255 711 A2 | 2/1988 |
| EP | 0 363 346 | 4/1990 |
| EP | 0 404 698 A1 | 12/1990 |
| EP | 544 493 A1 | 11/1992 |
| EP | 0 544 493 A1 | 6/1993 |
| GB | 2 200 365 A | 8/1988 |
| WO | 94/07980 | 4/1994 |
| WO | 96/34092 | 10/1996 |
| WO | 97/32917 | 9/1997 |
| WO | 98/56890 | 12/1998 |

OTHER PUBLICATIONS

International Search Report PCT/EP 99/08319 dated Oct. 21, 1999.

Partial International Search Report PCT/EP 99/08320 dated Feb. 29, 2000.

Database WPI, Derwent Publications Ltd., XP002128906.

Partial International Search Report PCT/EP 99/08320 dated Feb. 29, 2000.

Database WPI, Derwent Publications Ltd., XP002128906.

*Primary Examiner*—Cynthia H. Kelly
*Assistant Examiner*—Dawn Garrett
(74) *Attorney, Agent, or Firm*—Alan A. Bornstein

(57) ABSTRACT

The present application relates to the inclusion of one or more wrinkle reducing ingredients in a laundry detergent product. The benefits are delivered to the laundered item during the cleaning step and, therefore, reduces the need for further wrinkle reducing steps when the items are taken from the dryer or after hang drying.

8 Claims, No Drawings

U.S. PATENT DOCUMENTS 5,681,355 A 10/1997 Davis et al.
5,686,404 A 11/1997 Jeuniaux
5,714,453 A 2/1998 Neumiller
5,731,278 A 3/1998 Nair et al.
5,736,502 A * 4/1998 Wilkinson ..... 510/444
5,741,760 A 4/1998 Mondin et al.
5,759,208 A 6/1998 Zhen et al.
5,759,983 A 6/1998 Mondin et al.
5,762,647 A 6/1998 Brown et al.
5,804,544 A 9/1998 Powell et al.
5,977,045 A 11/1999 Murphy
6,004,538 A * 12/1999 Hughes et al. ..... 424/49

* cited by examiner

WRINKLE REDUCTION LAUNDRY PRODUCT COMPOSITIONS

RELATED APPLICATIONS

This applications claims priority to Provisional application Ser. No. 60/105,865 filed Oct. 27, 1998 and is a continuation-in-part of application Ser. No. 09/293,754 filed Apr. 16, 1999.

BACKGROUND

When textiles, such as clothing, linens and the like, are laundered, it is typically desired that wrinkles be eliminated or minimized after the cleaning and drying process. Mechanical wrinkle reduction techniques, such as heat and pressure (for example, ironing), have been used but can be time consuming and inconvenient.

Known attempts to reduce wrinkles by means of chemical ingredients in the wash include the use of zwitterionic surfactants, aminosilicones, curable aminosilicones, cellulase enzymes and alkyl amides. However, each of these ingredients have one or more drawbacks. For example, zwitterionic surfactants are believed to work best in cold water. Aminosilicones can cause yellowing and can be difficult to formulate. Curable aminosilicones require the heat of an iron to reduce wrinkles. Cellulase enzymes generally require several wash cycles before anti-wrinkle benefits become noticeable. Alkyl amides are not very effective relative to other wrinkle reducing agents.

Therefore, there is a need for an effective and efficient means for eliminating or reducing wrinkles in textiles. To be effective and efficient, the ingredient should preferably work across a broad range of water temperatures, not require the use of an iron, have little to no discoloration effect on the laundered item and/or provide a noticeable wrinkle reducing benefit after relatively few wash cycles.

SUMMARY

The present application relates to the inclusion of one or more wrinkle reducing ingredients in a laundry detergent product. The benefits are delivered to the laundered item during the cleaning step and, therefore, reduces the need for further wrinkle reducing steps when the items are taken from the dryer or after hang drying. Delivery can be achieved by direct dosing, drawer dispensing or by other known dosing means. Tablets can also be dosed in mesh bags.

The ingredients that facilitate the benefit of wrinkle reduction are believed to lubricate fiber surfaces. By lubricating the fiber surfaces of garments, for example, the fibers slide more easily relative to each other and are less likely to entangle, resulting in less wrinkles. The preferred fiber lubricants disclosed herein have been shown to noticeably reduce the number of wrinkles. The preferred embodiments also overcome one or more of the above noted disadvantages of prior wrinkle reducing agents or methods.

While it is known that lubricants can be used to reduce wrinkles in textiles, it was surprisingly found that these materials work from a main wash detergent. More particularly, main wash detergents are highly diluted and are subject to one or more rinse cycles. Such high dilution and rinsing would be expected to diminish or eliminate the desired wrinkle reduction effect of the lubricant.

DETAILED DESCRIPTION OF PREFERRED EMBODIMENTS

Several molecules have been identified for wrinkle reduction benefits when included in known liquid detergent formulations. Using the American Association of Textile Chemists and Colorists (AATCC) method # 124 (described in greater detail, below), the following molecular classes were found to reduce the number of wrinkles on test cloths: polyalkyleneoxide modified polydimethylsiloxane; linear aminopolydimethylsiloxane polyalkyleneoxide copolymers; sulfated/sulfonated vegetable oils, such as sulfated canola oil or sulfated castor oil; high molecular weight polyacrylamides; betaine siloxane copolymers; and alkylactam siloxane coplymers. Of the foregoing, a most preferred wrinkle reducing agent is a polyalkyleneoxide modified polydimethylsiloxane, sold under the name Silwet L-7622, available from Witco, Greenwich, Conn. Other most preferred wrinkle reducing agents are sulfated canola oil and/or castor oil available from Freedom Chemical Co., Charlotte, N.C.

One or more of the molecules/compounds from the above-identified classes are preferably included in known detergent formulations in an effective amount sufficing to reduce the occurrence of wrinkles as compared to clothing laundered and dried in a similar manner with a detergent formulation that excludes the wrinkle reducing agents. An effective amount of the wrinkle reducing ingredient is preferably from about 0.1 wt % to about 5 wt % and most preferably from about 0.3 wt % to about 1.5 wt %. However, sulfated/sulfonated vegetable oils can be used at even higher levels, such as from 0.1 wt % to 10 wt % due to their ease of formulation and relatively low cost. Suitable liquid detergent formulations are described, for example, in U.S. Pat. Nos. 4,261,868; 4,322,308; 4,959,179; 5,089,163; 5,147,576; and 5,205,957, all of which are incorporated herein by reference.

An additional advantage of the above-identified wrinkle reducing ingredients is that the molecules/compounds do not have a net positive charge in a neutral or alkaline medium, i.e. a medium having a pH greater than or equal to about 6.5. Lack of a net positive charge makes their inclusion in liquid detergents containing anionic surfactants much easier. More specifically, they are less likely to precipitate with negatively charged surfactants.

A further advantage is the likelihood of "yellowing" fabrics with the above wrinkle reducing molecules is less than with amine-containing ingredients. In addition, some of the above wrinkle reducing ingredients, such as sulfated vegetable oils, are relatively inexpensive.

Test Method and Examples

Wrinkle reduction was measured by using the American Association of Textile Chemists and Colorists' (AATCC) method # 124, Appearance of Fabrics after Repeated Home Laundering. In this method, four cloth types (silk, rayon, cotton, and linen) are washed, dried and stored in a well defined way. The dried cloths are then evaluated for wrinkle content by comparison with wrinkle smoothness replicas which can be purchased from AATCC. Factors such as the light used, the angle of the cloths and replicas to the light, and the background are carefully controlled and described in the method. There are six replicas with values of 1, 2, 3, 3.5, 4, and 5 with 5 being perfectly smooth and 1 being very wrinkled. Three trained observers are asked to give a value of 1–5, to the nearest 0.5 unit, to each cloth based on which replica it most closely resembles. The results are totaled and averaged over the three observers for each cloth type. According to the method, a difference of greater than 0.17 between the results for two products indicates there is a significant difference at the 95% confidence level. A difference of greater than or equal to 0.25 indicates a significant difference at the 99% confidence level.

EXAMPLE 1

The following formulation containing a wrinkle reduction ingredient was produced:

| Formulation 1 | |
|---|---|
| Ingredient | Percent in Formula (by weight) |
| sodium alcohol ethoxy sulfate | 11.0 |
| 9EO alcohol ethoxylate | 6.0 |
| sodium linear alkyl benzene sulfonate | 6.0 |
| propylene glycol | 4.0 |
| Sorbitol | 3.5 |
| Borax | 2.0 |
| sodium citrate | 1.5 |
| Silwet L-7622* | 1.0 |
| protease enzyme | 0.25 |
| lipase enzyme | 0.5 |
| Water | to 100% |

*Wrinkle reduction agent - polyoxyalkylene modified polydimethylsiloxane from Witco Chemical Co.

Formulation 2 (the same as formulation 1 without the wrinkle reduction agent present) was also produced.

One wash with each detergent was performed using 111.4 g of detergent in 17 gallons of water at 95 F. In each wash, cotton swatches were included along with six pounds of cotton ballast. The cotton swatches were used to determine the level of wrinkle reduction.

Wrinkle reduction results gave a wrinkle score of 1.78 for the L-7622-containing detergent and 1.17 for the control. These results indicate a statistical win for the detergent containing L-7622 at the 99% confidence level.

EXAMPLE 2

The following formulation containing a wrinkle reduction ingredient was produced:

| Formulation 3 | |
|---|---|
| Ingredient | Percent in Formula |
| sodium alcohol ethoxy sulfate | 11.0 |
| 9EO alcohol ethoxylate | 6.0 |
| sodium linear alkyl benzene sulfonate | 6.0 |
| propylene glycol | 4.0 |
| Sorbitol | 3.5 |
| Borax | 2.0 |
| sodium citrate | 1.5 |
| Freedom Scano-75* | 1.0 |
| protease enzyme | 0.25 |
| lipase enzyme | 0.5 |
| Water | to 100% |

*Wrinkle reduction agent - sulfated canola oil from Freedom Chemical Co.

Formulation 4 (the same as formulation 3 without the wrinkle reduction agent present) was also produced.

One wash with each detergent was performed using 111.4 g of detergent in 17 gallons of water at 95 F. In each wash, silk swatches were included along with six pounds of cotton ballast. The silk swatches were used to determine the level of wrinkle reduction. Wrinkle reduction results gave a wrinkle score of 2.89 for the Freedom Scano75-containing detergent and 2.39 for the control.

These results indicate a statistical win for the detergent containing Freedom Scano-75 at the 99% confidence level.

The following formulations show preferred ranges of ingredients in accordance with the present disclosure. Formulations 5 and 7 represent detergents having ethoxylated organosilicone copolymers as the wrinkle reducing agent while formulations 6 and 8 represent detergents having sulfated castor oil as the wrinkle reducing agent. Formulations 9 and 10 represent powdered and tabulated formulations, respectfully.

| FORMULATION 5 | |
|---|---|
| Ingredient-Chemical Name | Percent in Formula (Based on 100% Active Raw) |
| ALCOHOL ETHOXYLATE | 4.0–15.0 |
| SODIUM ALKYL ETHOXY SULFATE | 7.0–25.0 |
| ALKYLBENZENE SULFONIC ACID | 4.0–15.0 |
| SODIUM HYDROXIDE | 0.3–2.5 |
| PROPYLENE GLYCOL | 2.0–10.0 |
| SORBITOL | 2.0–10.0 |
| SODIUM TETRABORATE PENTAHYDRATE | 2.0–10.0 |
| SODIUM CITRATE DIHYDRATE | 1.5–10.0 |
| ETHOXYLATED ORGANOSILICONE COPOLYMER | 0.5–5.0 |
| COCONUT FATTY ACID | 0.4–2.5 |
| FLUORESCENT WHITENING AGENT | 0.1–0.6 |
| ANTIREDEPOSITION AGENT | 0.15–1.5 |
| Enzyme-Protease | 0.15–1.5 |
| Enzyme-Lipase | 0–2.0 |
| MONOETHANOLAMINE | 0.1–1.5 |
| PERFUME | 0.1–1.0 |
| WATER to 100% | |

| FORMULATION 6 | |
|---|---|
| Ingredient-Chemical Name | Percent in Formula (Based on 100% Active Raw) |
| ALCOHOL ETHOXYLATE | 4.0–15.0 |
| SODIUM ALKYL ETHOXY SULFATE | 7.0–25.0 |
| ALKYLBENZENE SULFONIC ACID | 4.0–15.0 |
| SODIUM HYDROXIDE | 0.3–2.5 |
| PROPYLENE GLYCOL | 2.0–10.0 |
| SORBITOL | 2.0–10.0 |
| SODIUM TETRABORATE PENTAHYDRATE | 2.0–10.0 |
| SODIUM CITRATE DIHYDRATE | 1.5–10.0 |
| SULFATED CASTOR OIL | 0.5–10.0 |
| COCONUT FATTY ACID | 0.4–2.5 |
| FLUORESCENT WHITENING AGENT | 0.1–0.6 |
| ANTIREDEPOSITION AGENT | 0.15–1.5 |
| Enzyme-Protease | 0.15–1.5 |
| Enzyme-Lipase | 0–2.0 |
| MONOETHANOLAMINE | 0.1–1.5 |
| PERFUME | 0.1–1.0 |
| WATER to 100% | |

| FORMULATION 7 | |
|---|---|
| Ingredient-Chemical Name | Percent in Formula (Based on 100% Active Raw) |
| ALCOHOL ETHOXYLATE | 3.5–20.0 |
| ALKYLBENZENE SULFONIC ACID | 9.5–30.0 |
| SODIUM HYDROXIDE | 1.0–10.0 |
| ETHOXYLATED ORGANOSILICONE COPOLYMER | 0.5–5.0 |
| SODIUM XYLENE SULFONATE | 0.75–10.0 |
| STEARIC ACID | 0.09–0.5 |

-continued

FORMULATION 7

| Ingredient-Chemical Name | Percent in Formula (Based on 100% Active Raw) |
|---|---|
| SODIUM SILICATE | 2.0–12.0 |
| FLUORESCENT WHITENING AGENT | 0.04–0.4 |
| PERFUME | 0.1–1.0 |
| WATER to 100% | |

FORMULATION 8

| Ingredient-Chemical Name | Percent in Formula (Based on 100% Active Raw) |
|---|---|
| ALCOHOL ETHOXYLATE | 3.5–20.0 |
| ALKYLBENZENE SULFONIC ACID | 9.5–30.0 |
| SODIUM HYDROXIDE | 1.0–10.0 |
| SULFATED CASTOR OIL | 0.5–10.0 |
| SODIUM XYLENE SULFONATE | 0.75–10.0 |
| STEARIC ACID | 0.09–0.5 |
| SODIUM SILICATE | 2.0–12.0 |
| FLUORESCENT WHITENING AGENT | 0.04–0.4 |
| PERFUME | 0.1–1.0 |
| WATER to 100% | |

FORMULATION 9 (Detergent Powder)

| | |
|---|---|
| Linear alkylbenzene sulfonate (LAS) | 13.8% |
| Ethoxylated nonionics (5 to 15 moles EO) | 5.2% |
| Sodium aluminosilicate | 28% |
| Sodium carbonate | 20% |
| Sodium sulfate | 18% |
| Sodium silicate | 0.5% |
| Polyacrylates | 1.4 |
| Sodium perborate | 0 to 8% |
| Protease enzyme | 0.5% |
| Perfume | 0.4% |
| Fluorescent Whitener | 0.3% |
| Anti-Wrinkle agent | See Table A |
| Water and miscellaneous | to 100% |

FORMULATION 10 (Detergent Tablet)

| | |
|---|---|
| Linear alkylbenzene sulfonate | 9.4% |
| Ethoxylated nonionics (5 to 15 mole EO) | 4% |
| Sodium aluminosilicate | 25% |
| Sodium carbonate | 24.5% |
| Sodium sulfate | 5.4% |
| Sodium Acetate trihydrate | 25% |
| Fluorescent whitener | 0.3% |
| Stearic soap | 0.75% |
| Perfume | 0.4% |
| Protease enzyme | 0.5% |
| Polyacrylates | 1.2% |
| Anti-Wrinkle ingredients | See Table A |
| Water and miscellaneous | to 100% |

TABLE A (Anti-wrinkle Ingredients)

| | |
|---|---|
| Ethoxylated organosilicones | 1–10% |
| Polyalkyleneoxide modified polydimethylsiloxane | 1–10% |
| Linear aminopolydimethylsiloxane polyalkyeneoxides | 1–10% |
| Sulfated oil | 1–10% |

Components in Table A can either be used individually or in combination with the total level being preferably between about 1 to about 10%.

While the above-identified wrinkle reducing agents are preferably incorporated in detergent compositions, they can also be used in other formulations, such as in rinse treatments or other garment care products.

All component percentages are based on weight, unless otherwise indicated. All numerical values are considered to be modified by the term "about" and should be given the broadest available range of equivalents when construing the claims.

What is claimed is:

1. A method of reducing the occurrence of wrinkles in laundered clothing comprising:

providing a powdered detergent formulation comprising at least one wrinkle reducing agent selected from the group consisting of polyalkyleneoxide modified polydimethylsiloxane, linear aminopolydimethylsiloxane polyalkyleneoxide copolymers, sulfated vegetable oils, sulfonated vegetable oils, betaine siloxane copolymers, and alkylactam siloxane copolymers;

contacting the powdered detergent formulation with clothing during a washing procedure; and allowing the clothing to dry; wherein the laundered clothing has fewer wrinkles present than clothing laundered and dried in an identical manner with a powdered detergent formulation that excludes the at least one wrinkle reducing agent.

2. A method of reducing the occurrence of wrinkles in laundered clothing comprising:

providing a tablet laundry detergent formulation comprising at least one wrinkle reducing agent selected from the group consisting of polyalkyleneoxide modified polydimethylsiloxane, linear aminopolydimethylsiloxane polyalkyleneoxide copolymers, sulfated vegetable oils, sulfonated vegetable oils, betaine siloxane copolymers, and alkylactam siloxane copolymers;

contacting the tablet laundry detergent formulation with clothing during a washing procedure; and allowing the clothing to dry; wherein the laundered clothing has fewer wrinkles present than clothing laundered and dried in an identical manner with a tablet laundry detergent formulation that excludes the at least one wrinkle reducing agent.

3. A powdered laundry detergent formulation comprising one or more wrinkle reducing agents selected from sulfated vegetable oils and sulfonated vegetable oils; said vegetable oils being in a concentration range of 0.5 to about 10 wt % of the formulation.

4. The formulation according to claim 3 wherein the wrinkle reducing agent is sulfated castor oil.

5. The formulation according to claim 3 wherein the wrinkle reducing agent is sulfated canola oil.

6. The formulation according to claim 3, wherein at least one of the wrinkle reducing agent is present in the formulation in an amount from about 0.5 wt % to about 1.5 wt % of the formulation.

7. A tablet detergent formulation comprising one or more wrinkle reducing agents selected from sulfated vegetable oils; and sulfonated vegetable oils; said vegetable oils being present in a concentration range of about 0.5 to about 10 weight % of the formulation.

8. A tablet detergent formulation comprising one or more wrinkle reducing agents selected from polyalkyleneoxide modified polydimethylsiloxane and betaine siloxane copolymers; and wherein said formulation contains a disintegrant.

* * * * *